United States Patent [19]

Harrington

[11] 3,936,745

[45] Feb. 3, 1976

[54] METHOD OF MEASURING THE DURATION OF A DISCONTINUOUS SIGNAL

[75] Inventor: Timothy M. Harrington, Sierra Madre, Calif.

[73] Assignee: MDH Industries, Inc., Monrovia, Calif.

[22] Filed: Nov. 12, 1974

[21] Appl. No.: 523,119

[52] U.S. Cl. ..... 324/186; 324/78 D; 328/129

[51] Int. Cl.[2] ..... G04F 10/00

[58] Field of Search ..... 328/111, 129, 130; 307/234; 324/78 D, 186

[56] References Cited

UNITED STATES PATENTS

| | | | |
|---|---|---|---|
| 3,296,525 | 1/1967 | Sakuma | 324/186 |
| 3,461,322 | 8/1969 | Hirsch et al. | 328/129 X |
| 3,579,126 | 5/1971 | Paul | 328/129 |
| 3,790,881 | 2/1974 | Smith | 328/111 X |
| 3,852,677 | 12/1974 | Neuville | 328/111 X |
| 3,854,472 | 12/1974 | Giroi et al. | 324/186 X |

*Primary Examiner*—John S. Heyman
*Attorney, Agent, or Firm*—Arthur V. Doble

[57] ABSTRACT

A method of measuring the duration of a discontinuous signal, which consists of groups of pulses with the duration of the gap between individual pulses in the same group being smaller then the time between groups, includes the steps of starting a time-measuring device at the time of arrival of the leading edge of the first pulse in the group whose duration is to be measured, copying the measured value from the time-measuring device without stopping that time-measuring device whenever signal gaps occur, storing each successive measured value until a timer examining the signal gaps determines that no signals have occurred for a preselected time, and displaying the measured value of the time copied from the time-measuring device at the last instant that the pulsating signal was present.

10 Claims, 2 Drawing Figures

METHOD OF MEASURING THE DURATION OF A DISCONTINUOUS SIGNAL

BACKGROUND OF THE INVENTION

1. Field of the Invention

The present invention relates to methods of measuring electrical signals and more particularly to a method of measuring the duration of a discontinuous signal which consists of a group of pulses with the duration of the gap between individual pulses in the same group being smaller than the time between groups.

2. Description of the Prior Art

In some electronic instruments, it is necessary to measure the time during which a discontinuous signal is present. If the signal contains gaps which should be ignored in the time-duration measurement, then problems arise which are not solved by standard prior-art devices for simply measuring time intervals.

Consider the case, for example, where the input signal has been converted to digital form and is composed of groups of pulses, with the separation between individual pulses in the same group being distinctly smaller than the separation between pulse groups. In this case, it is desired to measure the time during which the pulse group is present, starting at the leading edge of the first pulse and ending at the trailing edge of the last pulse within the same group, without regard to the relatively small gaps between the individual pulses within that group.

One method for measuring this time interval is to pass the discontinuous input pulse through an analog filter with a response time which is sufficiently slow so that a subsequent discriminator does not detect the pulse gaps. Then the width of the discriminator output pulse, which becomes a smoothed version of the original discontinuous input signal, can be measured by well-known techniques.

However, the required response time of the analog filter depends upon the duration of the gaps between the pulses in the same pulse group. If these gaps are variable, then the filter response time must often be repeatedly adjusted to compensate for this variation. Furthermore, in the event that the total width of the pulse group is not much larger than the largest gap between the pulses within the same group, then the response of the analog filter must become comparable to the duration of the pulse group itself. In that case the analog filter may introduce time-delay errors which are intolerably large.

A second common method for handling discontinuous signals of this nature is applicable whenever the pulses within the same pulse group always occur at a known periodic rate. In that case one may simply count the number of pulses present in a given group and compute the time duration of the group from the known pulse period. However, in the general case where the pulses are not periodic or the pulse period is unknown, this method cannot be used.

SUMMARY OF THE INVENTION

This invention provides a method of measuring the duration of such a discontinuous signal by starting the operation of a time-measuring device at the time of arrival of the leading edge of the first pulse in the pulse group whose duration is to be measured, and by copying into an output register the measured time duration from the time-measuring device whenever a gap between pulses occurs. When a timer examining the duration of the gaps between pulses determines that no new pulses have occurred for a preselected time after a gap began, the time-measuring device is stopped, and the last duration measurement stored in the output register is available for display.

It is an object of this invention to provide an improved method and apparatus for the measurement of the duration of a discontinuous signal containing groups of pulses, measuring said duration from the time at which the first pulse of a group appears until the end of the last pulse within that same pulse group.

It is another object of this invention to provide an improved method and apparatus for the measurement of the duration of the discontinuous signal produced by a device for monitoring the beam generated by *x*-ray machines for the purpose of determining the duration of a burst of *x*-rays.

It is a further object of this invention to provide an improved method and apparatus for the measurement of the duration of a signal from an *x*-ray-detecting device so that the signal duration is correctly determined without regard to whether the *x*-ray-tube power supply is of the half-wave, full-wave, three-phase or dc type.

It is a further object of this invention to provide an improved method and apparatus for the measurement of the duration of a signal from an *x*-ray-detecting device so that measurements of signal durations from a minimum of 1 millisecond up to and exceeding 100 seconds may be made without adjustments and with high accuracy.

The preferred embodiment of this invention utilizes digital techniques to achieve accuracy, reliability and simplicity.

For a more complete understanding of the present invention, reference is made to the following description taken in connection with the accompanying drawings in which preferred embodiments of the invention are illustrated, the scope of the invention being pointed out and contained in the appended claims.

DESCRIPTION OF THE PREFERRED EMBODIMENTS

Figure 1:
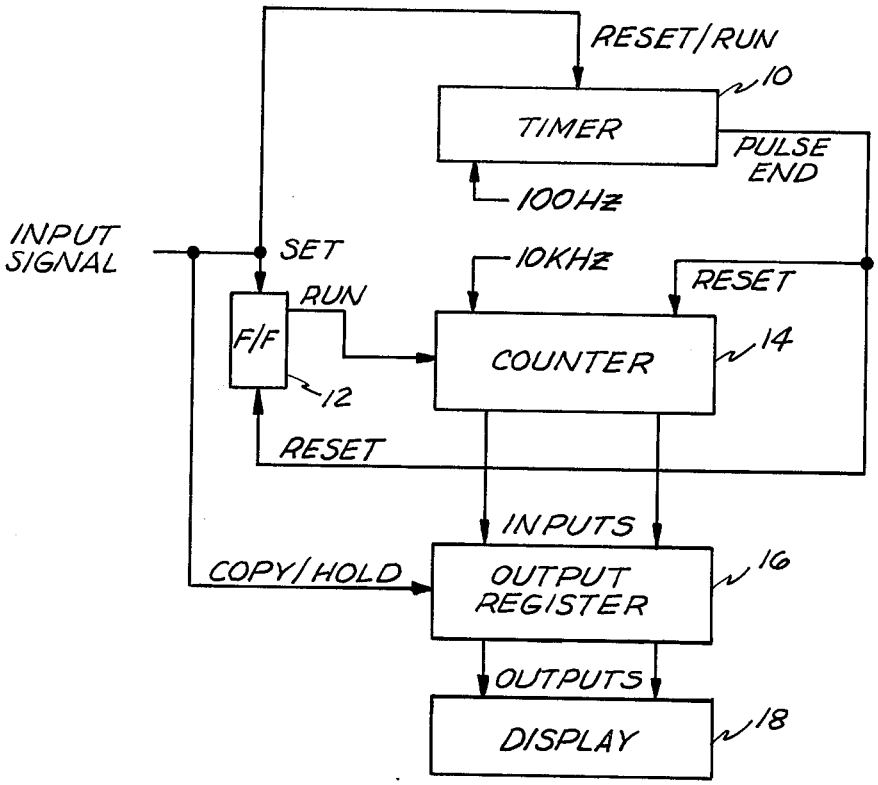
FIG. 1 shows a block diagram of the measurement system utilizing the features of the present invention.

The diagram of FIG. 1 illustrates a particular embodiment of the invention, one that is used to measure the width of *x*-ray pulses from diagnostic *x*-ray machines that employ unfiltered full-wave or half-wave power supplies that produce 120 or 60 pulsations per second during the time the *x*-ray machine is producing an *x*-ray burst. In this embodiment, a device, which is not a part of this invention, detects the presence of these *x* rays and generates the digital INPUT SIGNAL shown in FIG. 1. The 1 state of this signal signifies that the *x*-ray intensity exceeds a preset threshold.

The operation of the circuit is based upon the functions of the five blocks illustrated in FIG. 1. The functions of each block are first described, and then the sequence of events that occur when a pulsating signal is applied to the system is presented. All signals depicted are considered to be digital in nature; thus they are either logic 1 or logic 0 and only briefly are they of any intermediate value.

The block depicting timer 10 operates on two signals, RESET/RUN and the time signal 100 Hz, and produces the signal PULSE-END at its output. If the RESET/-RUN signal is at a logic 1, then the timer 10 is held in a first state and the PULSE-END signal is at a logic 0. When the RESET/RUN signal becomes logic 0, the timer runs until four 100-Hz signals have occurred, after which the PULSE-END signal becomes a logic 1 and the timer 10 waits in a second state, disregarding all subsequent 100-Hz input signals. It is evident that the circuit of FIG. 1 may be made to assume other values of time delay by changing the frequency of the 100-Hz input, or by making modifications to the design of the timer 10 to count more or fewer pulses. The timer 10 may be any one of a multiplicity of time-delay circuits commonly known to those skilled in the art.

The block depicting F/F 12 is a simple set-reset bistable element producing the RUN signal. If a logic 1 is applied to the SET input, then the RUN output will become a logic 1. If the RESET input is maintained at a logic 0, then the SET input may return to logic 0, and the RUN output will remain at logic 1. When a logic 1 is applied to the RESET input and there is logic 0 at the SET input, then the RUN output becomes a logic 0 and remains logic 0 until a logic 1 is applied to the SET input.

The time-measuring device is depicted as the block labeled counter 14. Counter 14 is a digital counting circuit that counts 10-kHz pulses whenever the RUN input is a logic 1 provided that the RESET input is a logic 0. The number in the counter 14 is forced to a value of zero whenever a logic 1 is applied to the RESET input without regard to the signals applied to the RUN and 10-kHz inputs. The number in the counter 14 is presented to the output register 16 as it accumulates in the form of 24 signals representing a six-digit binary-coded decimal number representing up to 99.9999 seconds. This method of counting and storing pulses is commonly used by those skilled in the art. Other types of counting techniques, providing different ranges of time intervals, fewer or more digits, and non-electrical timing, could be used.

The output register 16 stores the input signals it receives from counter 14 and presents these signals to the display 18. As long as the COPY/HOLD signal is a logic 1, the outputs and inputs of output register 16 represent the time measurement in counter 14. When the COPY/HOLD signal becomes a logic 0, then the outputs from output register 16 remain fixed at the values corresponding the time measurement present just prior to the logic-1-to-logic-0 transition of the COPY/HOLD signal. The display 18 provides a visible indication of the number stored in the output register 16.

Figure 2:
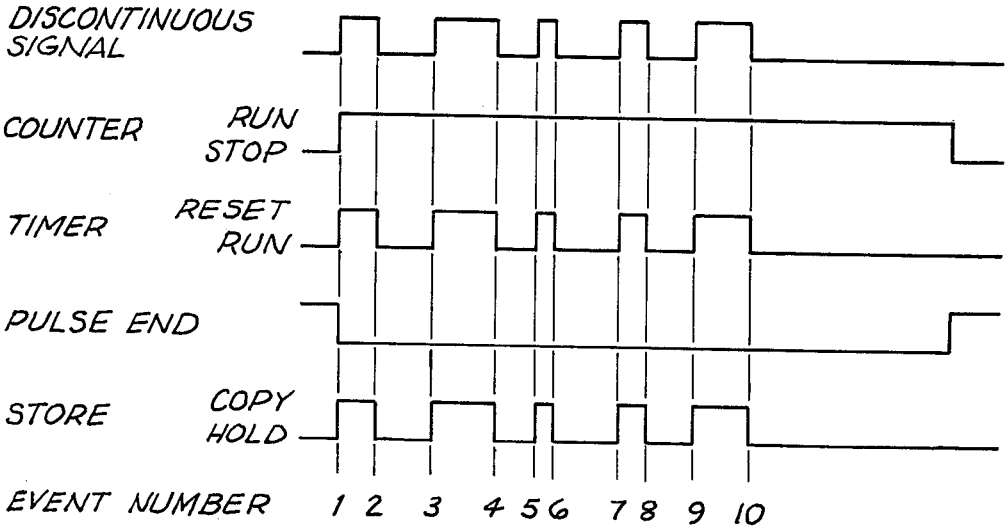
FIG. 2 shows a timing diagram illustrating a discontinuous signal and the signals within the block diagram of FIG. 1 in order to illustrate the operating principle of the system.

The cooperation of these blocks to produce the desired measurement may be understood by reference to FIG. 2 and to the following description. Assume that initially no pulses have been detected for approximately 100 ms. Then the signals will be as shown to the left of event 1 in FIG. 2. The PULSE-END signal will be logic 1, holding the counter 14 reset. Now consider event 1, where the INPUT SIGNAL becomes a logic 1. This resets the timer 10, causing PULSE-END to be a logic 0, and allowing the counter 14 to start accumulating time pulses at a 10-kHz rate. At event 2, the input signal becomes a logic 0. This causes the timer 10 to begin timing its 35-ms delay period, holds stored the time count corresponding to the interval from 1 to 2 in the output register 16, but does not stop the counter 14 from accumulating 10-kHz clock pulses. At event 3 where it has been assumed that the pulse gap from events 2 to 3 is less than the 35-ms delay period of timer 10, the output register 16 again begins copying the counter 14 value, and the timer 10 is reset back to zero. At event 4, the timer 10 again starts its delay while the output register 16 stores the time count representing the event 1 to event 4 interval. This process continues in this manner until 35 ms after event 10. At event 10, the output register 16 contains the time count representing the interval from event 1 to event 10. If, as shown, after 35 ms no further pulses have occurred, the system will stop counting time but will retain the output value in the storage register 16 for display by 18 or for other use. It should be evident from this discussion that the timer 10 does not affect the measured value of the signal duration because it only is used to recognize when the discontinuous signal has ended, and thus timer 10 may be adjusted to any value so long as this value exceeds the maximum discontinuity or signal gap in the INPUT SIGNAL. For the specific embodiment presented here, a value of 35 ms is chosen to accommodate discontinuities representative of 50-Hz, 60-Hz, 100-Hz, 120-Hz, 150-Hz, and 180-Hz power systems that may be encountered in *x*-ray-tube measurements. It should also be evident that the system functions properly with continuous signals containing no gaps as well as with discontinuous signals.

What is claimed as new is:

1. For use in an electrical circuit, a method of measuring the duration of a discontinuous signal, which consists of groups of pulses with the duration of the gap between individual pulses in the same group being smaller than the time between groups, comprising the steps of:

a. starting the operation of a time-measuring device at the time of arrival of the leading edge of the first pulse in the pulse group whose duration is to be measured;

b. copying the measured value from the time-measuring device, without stopping the time-measuring device, at the time of arrival of the trailing edge of the first pulse in the pulse group whose duration is to be measured; and c. storing the copied measured value from the time-measuring device during gaps in the discontinuous signal.

2. The method of claim 1, above, further comprising the additional step of displaying the stored copied measured value as an indication of the measured duration of the discontinuous signal.

3. The method of claim 1, above, further comprising the additional steps of examining the discontinuous signal to determine whether any signal has occurred for a preselected time interval, and stopping the time-measuring device only after determining that no signals have occurred for a preselected time interval.

4. The method of claim 3, above, further comprising the additional step of displaying the stored copied measured value as an indication of the measured duration of the discontinuous signal.

5. For use in an electrical circuit, a method of measuring the duration of a discontinuous signal, which consists of groups of pulses with the duration of the gap between individual pulses in the same group being smaller than the time between groups, comprising the steps of:

a. starting the operation of a digital counter to accumulate periodic clock signals at the time of arrival of the leading edge of the first pulse in the pulse group whose duration is to be measured;

b. copying the number of clock signals contained in the digital counter only when the applied discontinuous signal is present; and c. storing the copied number of clock signals in a register during gaps in the signal.

6. The method of claim 5, above, further comprising the additional step of displaying the stored copied number as an indication of the measured duration of the discontinuous signal.

7. The method of claim 5, above, further comprising the additional steps of examining the discontinuous signal to determine whether any signal has occurred for a preselected time interval, and stopping the time-measuring device after determining that no signals have occurred for a preselected time interval.

8. The method of claim 7, above, further comprising the additional step of displaying the stored copied number of clock signals as an indication of the measured duration of the discontinuous signal.

9. For use in an electrical circuit, a method of measuring the duration of a discontinuous signal, which consists of groups of pulses with the duration of the gap between individual pulses in the same group being smaller than the time between groups comprising the steps of:

a. starting accumulation of 10-kHz clock pulses in a 6-digit decimal counter at the time of arrival of the leading edge of the first pulse in the pulse group whose duration is to be measured;

b. copying the 6-digit decimal number from the counter in a register separate from the counter as long as the signal is present;

c. storing the number present in the register at the beginning of each signal gap throughout the duration of the gap;

d. operating a preselected time interval timer whenever a signal gap occurs; and e. ending the duration measurement when the timer determines that the signal gap duration exceeds the preselected time interval.

10. The method of claim 9, above, further comprising the additional step of displaying the stored decimal number as an indication of the measured duration of a discontinuous signal.

* * * * *